United States Patent [19]

Cox-Smith et al.

[11] Patent Number: 4,515,582

[45] Date of Patent: May 7, 1985

[54] METHOD OF INITIATING AN OPERATION

[75] Inventors: Peter Cox-Smith, Bletchley; Colin Calvert, Ampthill; John Wesley, Wavendon, all of England

[73] Assignee: Hoccum Developments Limited, Slough, England

[21] Appl. No.: 468,563

[22] Filed: Feb. 22, 1983

[30] Foreign Application Priority Data

Feb. 22, 1982 [GB] United Kingdom ..... 8205154

[51] Int. Cl.[3] ..... B04B 13/00

[52] U.S. Cl. ..... 494/7; 494/9

[58] Field of Search ..... 310/113; 494/1, 7, 8, 494/9, 37, 84

[56] References Cited

U.S. PATENT DOCUMENTS

| | | | |
|---|---|---|---|
| 3,970,245 | 7/1976 | Aeschlimann | 494/9 |
| 4,138,629 | 2/1979 | Miller et al. | 310/113 |
| 4,397,637 | 8/1983 | Place | 494/1 |

*Primary Examiner*—Robert W. Jenkins
*Assistant Examiner*—Arthur D. Dahlberg
*Attorney, Agent, or Firm*—Klarquist, Sparkman, Campbell, Leigh & Whinston

[57] ABSTRACT

A method of initiating an operation in dependence on the combined mass of an element and matter which is in or on the element can be used to remove matter which has accumulated on the rotor of a centrifuge. A substantial change is effected in the speed of rotation of the rotor and the rate of change is then measured. The operation is initiated when the rate of change is above or below a predetermined value.

13 Claims, 3 Drawing Figures

METHOD OF INITIATING AN OPERATION

BACKGROUND OF THE INVENTION

1. Field of the Invention

The invention relates to a method of initiating an operation in dependence upon the combined mass of an element and matter which is in or on the element. The invention also relates to a method of removing material from a driven element, and to a control means.

2. Brief Description of the Prior Art

The invention is concerned with the operation of a driven element wherein, during operation, there is an interchange of matter between the element and matter which flows through or over the element. An example of such an operation would be one in which matter flows through the element and a proportion thereof collects in the element during such operation. It is necessary periodically to carry out an operation upon the element such as the removal of matter which collects therein. In the past it has been necessary to stop the element in order to determine whether the element has reached a suitable stage in its operation for the initiation of such an operation.

SUMMARY OF THE INVENTION

According to a first aspect of the invention, there is provided a method of initiating an operation in dependence upon the combined mass of an element and matter which is in or on the element, comprising the steps of driving the element, passing a flow of matter over or through the element so that there is an interchange between the element and the flow, causing or permitting a substantial change in the speed at which the element is driven, measuring the rate of change of speed, and initiating the operation when the rate of change is above or below a predetermined value.

The rate of change of speed of the element will be, at least in part, dependent upon the combined mass of the element and matter which is in or on the element. Therefore, the operation is initiated in dependence upon the momentum of said combination.

Preferably, the change in speed of the element is brought about by applying a force to the element which is substantially the same for different cycles of operation of the method. The predetermined value can then be set by noting the rate of change of speed when the constant force is applied to an element upon which it is necessary to initiate the operation.

The change in speed of the element can be an increase or a decrease. An increase can be brought about by applying additional drive to the element, and a decrease can be brought about by removing the drive. Removal of the drive can be accompanied by the application of a known braking force or, alternatively, the change in speed can be brought about by the normal frictional forces which act upon the element.

According to a second aspect of the invention, there is provided a method of removing matter from a driven element when a predetermined quantity of the matter has been collected by the element, comprising the steps of removing drive from the driven element, measuring the rate at which the driven element slows down, and removing material which has been collected by the element when the rate of slowing down is below a predetermined value.

Preferably, the driven element is a rotor. The rotor can be the rotor of a centrifuge which, in use, separates less dense from more dense matter, the denser matter collecting in the rotor.

Preferably, the driven element is driven by a motor which is used as a generator driven by continued rotation of the rotor when the drive is removed therefrom. The rate at which the rotor slows down can be determined from measurements of the frequency of the signal generated motor.

According to a third aspect of the invention, there is provided a control means for a machine comprising a force means for applying force to the machine, and a sensing means responsive to the rate of change of speed of the machine due to the application of the force to provide an output which is a measure of the inertia of the machine.

If the machine comprises an electric motor drive, and said force is a braking force, it can be arranged that said drive is disconnected from its supply to act as a generator to produce signals dependent upon the rate of rotation whilst the machine is subject to the force, thereby providing the sensing means with signals related to the instantaneous speed. The sensing means can process these signals and produce an output which is dependent upon the change of motor speed.

Alternatively, the generation of measurement signals dependent upon the machine speed can be utilised by forming the signals as a train of pulses with a frequency dependent upon the rate of movement of the machine and transmitting the pulses through a gating device which comprises time delay means to block the signals when the pulse frequency falls below a predetermined value. The gating device provides an output which indicates that the machine speed has fallen below a predetermined minimum value.

Such an arrangement can be employed for various purposes, for example as a safety device for control of a locking means so as to allow access to the machine or some region of the machine only when it has been stopped or is running below a predetermined safe speed.

If required, the same measurement pulse train generated by the electric motor can be employed for operation of inertia sensing means and of the same or zero speed indication.

BRIEF DESCRIPTION OF THE DRAWINGS

An example of an application of a method, and of a control means in accordance with the invention will now be described, with reference to the accompanying drawings, wherein.

DESCRIPTION OF THE PREFERRED EMBODIMENTS

Figure 1:
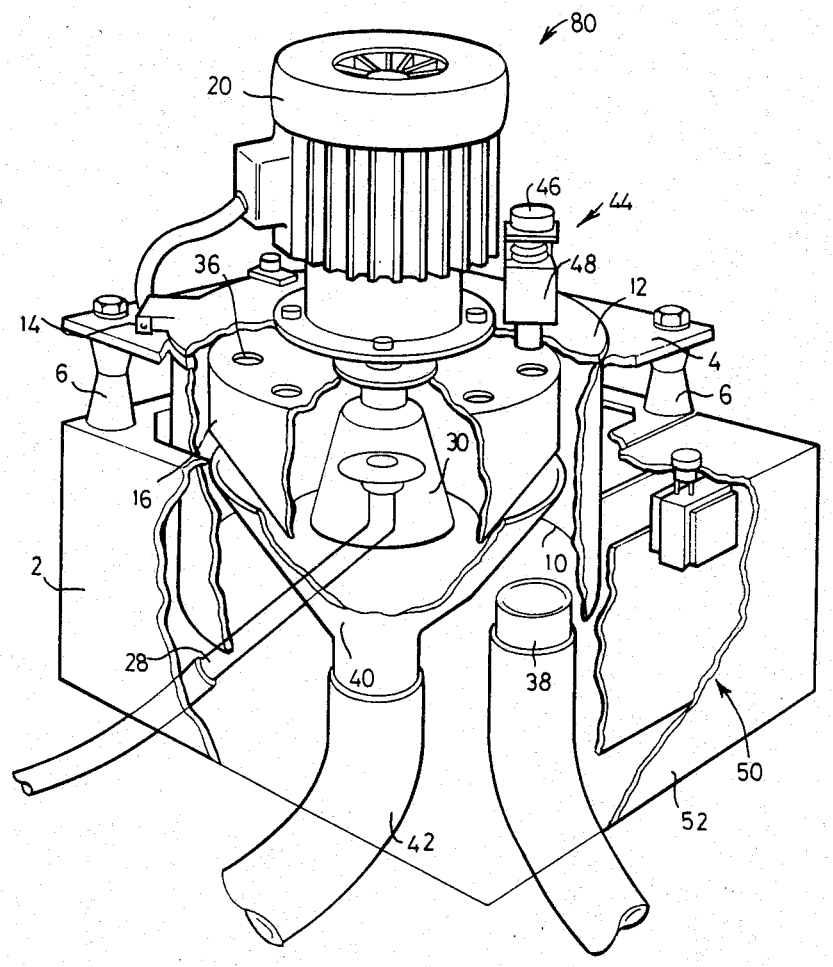
FIG. 1 is a cut-away perspective view of an apparatus.
Figure 2:
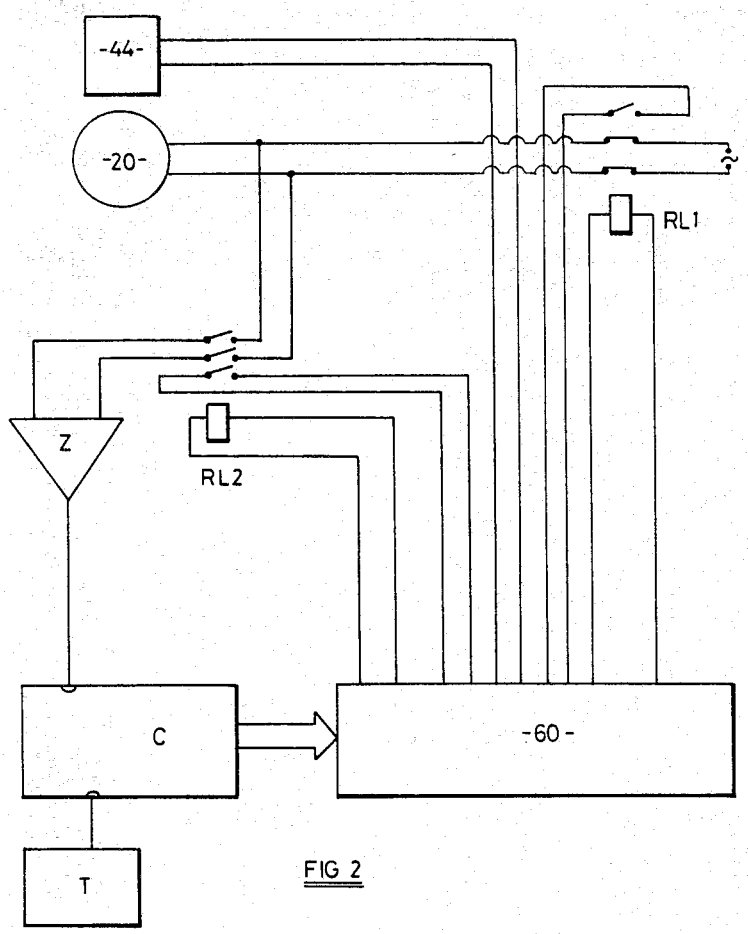
FIGS. 2 and 3 are schematic block diagrams illustrating the sensing and control means.

FIG. 1 shows apparatus which comprises a driven element and a drive element for driving the driven element. In the illustrated example, the driven element is driven rotationally, but it will be appreciated from the following description that the invention is equally applicable to a method wherein a driven element is driven translationally. In the illustrated example, the apparatus is a centrifuge 80 and the driven element is a rotor 16 which is driven by a drive element in the form of a synchronous electric motor 20.

The centrifuge 80 comprises an outer container 10 which is rigidly mounted by means of clamps on a platform 4. The platform is supported on a machine frame 2 by means of anti-vibration mountings 6. A central opening in the platform is covered by a lid 12 which is connected to the platform by hinge means 14. The electric motor is mounted on the lid and comprises a shaft (not shown) which defines a vertical axis when the lid is closed, as shown in the drawing. The rotor 16 is mounted on a downwardly depending portion of the shaft, inside the container.

When the centrifuge 80 is in use, a flow of matter in the form of a suspension of solids in a liquid is passed through the rotor as the rotor is driven, and there is an interchange of matter between the rotor and said flow whereby solids are separated from the liquid and deposited on the inwardly facing surface of a peripheral wall of the rotor. It will be appreciated that apparatus for carrying out a method in accordance with the invention can be provided in which matter passes over an outwardly facing surface of a driven element during operation of the apparatus. The interchange can involve a process whereby matter is removed from the driven element as said flow passes through or over the element. The interchange necessarily results in a change in the combined mass of the driven element and matter which is in or on the element. Where the driven element is driven rotationally, the interchange also results in a change in the moment of inertia of the combination. The inertia of said combination thereby changes during use of the apparatus.

When the centrifuge 80 is in use, a liquid containing solid material is fed along a pipe 28 into an entry cone 30 of the rotor 16. The suspension flows past a diaphragm valve 32 into the main body of the rotor, and centrifugal action causes solids in the suspension to be separated from the liquid and deposited on the inwardly facing surface of the peripheral wall of the rotor at a maximum diameter upper region thereof. The cleaned liquid escapes through openings 36 in the top of the rotor to flow between the rotor and the container 10 into an outlet conduit 38. The deposited solids are removed periodically from the wall of the rotor and are dropped through a hopper 40 which is concentric about the axis of rotation of the rotor and which leads to a waste outlet pipe 42.

An operation is initiated when the interchange between the driven element and the flow has reached a predetermined stage. The operation can be made upon the combination of driven element and matter therein or thereon. In the use of the apparatus illustrated in FIG. 1, a predetermined stage in the operation thereof is reached when the mass of solids which accumulate on the peripheral wall of the rotor reaches a predetermined value. An operation is then initiated to remove the solids from the rotor.

The operation is initiated in dependence upon a measurement of the rate of change of speed of the rotor when a substantial change in the speed at which the rotor is rotated is caused or permitted to occur. Such a change in speed can be effected by applying a known force to the rotor to increase the speed of rotation thereof. Alternatively, a known force can be applied to decrease the speed of the rotor, such as a known force being applied by a brake or by permitting the rotor to slow down. One method of permitting the rotor to slow down is to remove the drive therefrom so that known frictional forces slow the rotor down.

The operation is initiated when the rate of change of speed of the rotor is above or below a predetermined value. In the use of the illustrated example, the removal operation is initiated when the combined mass of the rotor and solids which have accumulated thereon has increased to a value such that the rate of slowing down is below a predetermined value.

The operation of the apparatus shown in FIG. 1 is controlled through a sequence and interlock logic circuit 60 which is part of a control unit 50 in a cabinet 52 mounted on the machine frame 2. Two friction brakes 44 are provided for slowing down the rotor. The brakes are mounted on the lid 12 at diametrically opposite sides of the motor 20. When the brakes are operated, pads thereof bear on an upwardly facing surface of the rotor 16. The brakes can be operated by means of respective solenoids which, when de-energised, permit the brakes to drop under gravity onto the upwardly facing surface of the rotor, or can be operated manually by means of spring loaded press caps 46.

The brakes 44 are spring loaded to apply a substantially constant braking force to the rotor 16. The brakes act upon a surface of the rotor which is bathed by the cleaned liquid which helps to ensure that the braking force is substantially constant. When the inertia of the rotor and solids which have accumulated thereon is to be sensed, isolation of the motor 20 from its power supply and operation of the brakes is synchronised. As can be seen from FIG. 1, a relay RL1 is operable under the control of the sequence and interlock circuit 60 to open the current supply leads to the motor and simultaneously to close a further contact to actuate a second relay RL2. The actuated second relay prevents further flow of liquid into the rotor and connects the motor current leads which have been isolated from the power supply to a zero crossing detector and level shift Z.

It will be appreciated that the activation of the second relay RL2 turns the motor 20 into a generator which is driven by rotation of the rotor 16. The rotor will continue to rotate immediately after the power supply has been isolated due to its inertia. The motor is then driven by the rotor to generate a signal and an A.C. output is transmitted to the detector Z.

Detector Z shapes the A.C. output to produce an amplified pulse train, the instantaneous frequency of which is directly dependent upon the rotor speed. The pulse train is fed to a counter C which is controlled by a timer T to count pulses over a predetermined time period, which count is a measure of the mean speed of the rotor during the time period. This value of the mean speed is compared with a further measure of the mean speed made at a different time to determine the rate of slowing down of the rotor. The further value can be a measure of the speed when the rotor is driven or the measure can be made at a known time interval before or after the one measure when the rotor is slowing down.

When the circuit 60 senses a change in the frequency of the signal provided by the motor 20 when acting as a generator, which change indicates that the inertia of the rotor and its contents is above a predetermined value, a removal operation is initiated. If the solids deposits are of such an adherent nature that they do not fall from the rotor when it is stopped, the motor 20 can be operated by the circuit 60 in a pre-programmed sequence to produce increased displacing forces by alternately speeding up and slowing down the rotor, or by reversing its direction of rotation. The preprogrammed sequence can be varied by substituting an alternative micro-chip in the circuit so that, for example, the number of reversals of the rotor can be varied. In an alternative form of centrifuge, the removal operation is effected by a scraper or suction nozzle.

Figure 3:
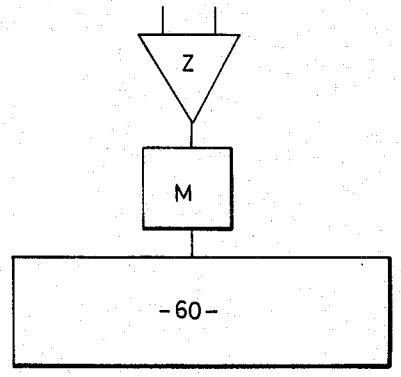

The circuit 60 can also be used to control a safety feature on the centrifuge 80 such as a locking latch (not shown) for the hinged lid 12. The output from the detector Z is fed to a blocking device which enables a signal to be transmitted from the circuit 60 when the frequency of the input has dropped below a predetermined level. The blocking device can be a retriggerable monostable M, as shown in FIG. 3, which blocks signals to the circuit only when the motor 20 has stopped or has virtually stopped. When the signals are blocked, the circuit 60 releases a locking latch for the hinged lid 12.

It will be understood that the safety device can be employed in a machine within the scope of the invention whether or not an inertia sensing means is also provided.

We claim:

1. A method of initiating an operation in dependence upon the combined mass of an element and matter which is in or on the element, comprising the steps of applying a driving force to the element, passing a flow of matter over or through the element so that there is an interchange between the element and the flow varying the driving force so as to substantially change the speed at which the element is driven, measuring the rate of change of speed, and initiating the operation when the rate of change of speed is above or below a predetermined value.

2. A method according to claim 1 wherein the step of varying the driving force comprises the step of varying the driving force to a known level.

3. A method according to claim 1 wherein the step of measuring the rate of change of speed comprises the steps of making first and second measurements of the speed of the element at different times and comparing the first and second measurements to determine the rate of change of speed.

4. A method according to claim 3 wherein the first of the measurements is made before the driving force is varied and the substantial change in speed occurs.

5. A method according to claim 3 wherein both of the first and second measurements are made after the driving force is varied and the substantial change in speed occurs, the first and second measurements being made a known interval of time apart.

6. A method according to claim 1 wherein the step of applying a driving force comprises the step of driving the element with a motor and the step of varying the driving force comprises the step of operating the motor as a generator so as to substantially change the speed of the element.

7. A method according to claim 6 wherein the step of measuring the rate of change of speed of the element comprises the step of measuring the frequency of the signal generated by the motor and determining the change of speed from the frequency measurements.

8. A method of removing matter from a driven element when a predetermined quantity of the matter has been collected by the element, comprising the steps of driving the driven element in the presence of the matter such that matter collects on the driven element, removing drive from the driven element, measuring the rate at which the driven element slows down, and removing matter which has been collected by the element when the rate of slowing down is below a predetermined value and thereby indicates that the predetermined quantity of matter has been collected by the element.

9. A method according to claim 8 wherein the driven element is a rotor.

10. A method according to claim 9 wherein the rotor is the rotor of a centrifuge which, in use, separates less dense from more dense matter, the denser matter collecting in the rotor.

11. A method according to claim 8 wherein the element is driven by a motor which is used as a generator when the drive is removed.

12. A method according to claim 11 wherein the rate at which the driven element slows down is determined from measurements of the frequency of the signed generated by the motor.

13. A control means for a machine having a drivable element which is adapted to collect matter as the element is driven comprising a force means for applying force to the machine for driving the drivable element; means for varying the force applied by said force means to vary the speed at which the drivable element is driven; and a sensing means reponsive to the rate of change of speed of the drivable element due to the application of the varied force to provide an output which is a measure of the inertia of the drivable element.

* * * * *

UNITED STATES PATENT AND TRADEMARK OFFICE

CERTIFICATE OF CORRECTION

PATENT NO. : 4,515,582

DATED : May 7, 1985

INVENTOR(S) : Peter Cox-Smith and John Wesley

It is certified that error appears in the above-identified patent and that said Letters Patent is hereby corrected as shown below:

Column 2, line 8, after "generated" insert --by the--.

Column 6, line 36, "signed" should be --signal--.

Signed and Sealed this

*Tenth* Day of *September 1985*

[SEAL]

*Attest:*

DONALD J. QUIGG

*Attesting Officer* *Acting Commissioner of Patents and Trademarks - Designate*